United States Patent [19]

Peise et al.

[11] 4,367,076

[45] Jan. 4, 1983

[54] METHOD AND APPARATUS FOR PROCESSING OF DUST-CONTAMINATED HOT PRODUCT GAS

[75] Inventors: Helmut Peise; Reinhard Brausse; Klaus Lucas; Klaus-Otto Kuhlbrodt, all of Freiberg; Friedrich Berger, Brand-Erbisdorf; Peter Göhler, Freiberg; Manfred Schingnitz, Freiberg; Dieter König, Freiberg, all of German Democratic Rep.; Aleksander Jegorow; Vasilij Fedotov; Vladimir Gavrilin; Ernest Gudymov; Vladimir Semenov; Igol Achmatov, all of Moskwa; Nikolaj Majdurov, Moskovsk; Evgenij Abraamov, Moskwa, all of U.S.S.R.

[73] Assignees: Brennstoffinstitut Freiberg, Freiberg, German Democratic Rep.; I Projektnyi Institut Asotnoj Promyschlennosti I Produktow Organitschewkogo Sintesa Gosudarstwennyi Nautschno-Issledowatelski, Moskow, U.S.S.R.

[21] Appl. No.: 249,662

[22] Filed: Mar. 26, 1981

Related U.S. Application Data

[63] Continuation of Ser. No. 104,895, Dec. 18, 1979, abandoned.

[51] Int. Cl.[3] ..... C10J 3/72

[52] U.S. Cl. ..... 48/128; 48/69; 48/197 R; 55/95; 55/256; 261/77; 261/123

[58] Field of Search ..... 48/215, 128, 62 R, 63, 48/64, 69, 73, 76, 77, DIG. 2, 206, 197 R; 55/255, 256, 95; 261/123, 77, 23 R; 202/269; 110/266, 165 R, 215

[56] References Cited

U.S. PATENT DOCUMENTS

| | | | |
|---|---|---|---|
| 2,871,114 | 1/1959 | Eastman | 48/206 |
| 3,617,033 | 11/1971 | Ichikawa et al. | 261/77 |
| 3,998,609 | 12/1976 | Crouch et al. | 48/202 |
| 4,214,880 | 7/1980 | Kamphorst | 55/256 |
| 4,259,536 | 3/1981 | Voeste et al. | 261/77 |

FOREIGN PATENT DOCUMENTS

| | | | |
|---|---|---|---|
| 2504 | of 1881 | United Kingdom | 48/76 |
| 8490 | of 1895 | United Kingdom | 261/23 R |

*Primary Examiner*—S. Leon Bashore, Jr.
*Assistant Examiner*—Michael Goldman
*Attorney, Agent, or Firm*—Michael J. Striker

[57] ABSTRACT

Dust-laden hot product gas under pressure is admitted into a vessel suspended in a water bath. It escapes through openings in the top of the vessel and the rising bubbles are intercepted by upright tubes through which they cause a flow of water to effect a turnover of the bath. This causes the gas to become cooled, dust to be scrubbed from it and the gas also to become saturated with water vapor.

9 Claims, 1 Drawing Figure

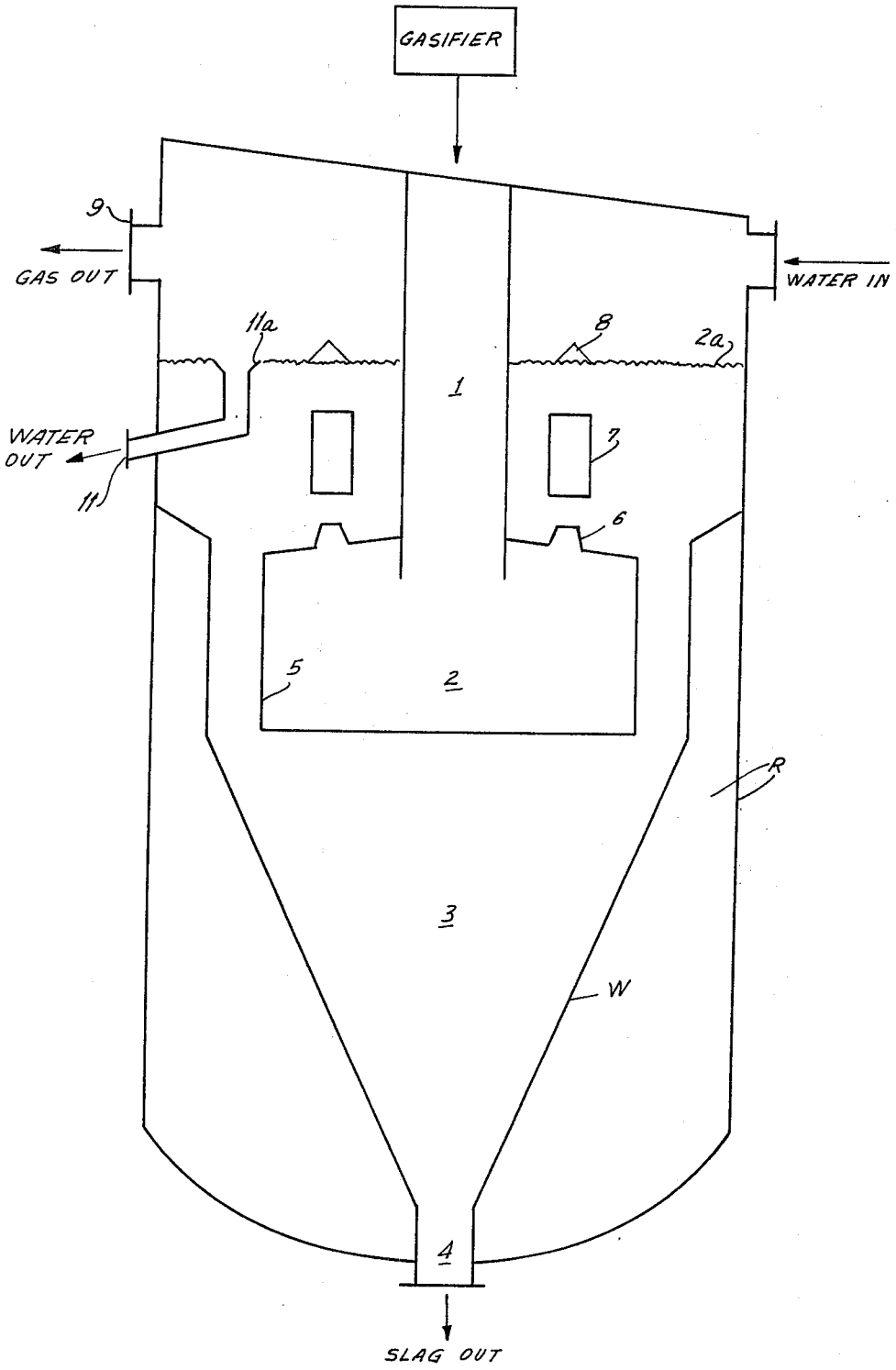
GASIFIER
9
GAS OUT
WATER IN
11a
8
2a
1
WATER OUT
11
7
6
5
2
R
3
W
4
SLAG OUT

METHOD AND APPARATUS FOR PROCESSING OF DUST-CONTAMINATED HOT PRODUCT GAS

This is a continuation of application Ser. No. 104,895, filed Dec. 18, 1979, now abandoned.

BACKGROUND OF THE INVENTION

This invention relates to the processing of product gases obtained by pressure gasification of finely divided (pulverulent)fuels.

More particularly, the invention relates to a method of processing gases of the type mentioned above to cool them, at least in part scrub them of entrained dust and saturate them with water vapor.

The invention also relates to an apparatus for carrying out the method.

When pulverulent solid fuel (e.g. coal dust) is gasified under pressure, dust-containing gas mixtures are obtained which leave the gasifying reactor at high temperature. If the gasification is carried out as a flame reaction at temperatures above the melting point of the ash residue remaining on gasification, then it is advantageous to discharge the hot product gas together with the hot liquefied ash (i.e. slag) and thereupon to contact both the gas (for cooling purposes) and the liquid slag (for solidification and concomitant granulation) with cooling water. The direct water-cooling of the hot gas results in partial conversion of the water into steam—and in the acquisition of a certain water vapor content in the cooled product gas.

Several types of water-cooling and/or scrubbing for dust renewal are known and described in W. Strauss "Industrial Gas Cleaning", Pergamon Press, 1975 and in E. Weber/W. Brocke "Apparate der industriellen Gasreinigung", Vol. 1 "Feststoffabsclerdung", R. Oldenburg Publishes, 1973.

One prior-art approach is to use scrubbers in which water trickling or being sprayed in counterflow to the gas is made to contact the gas. The contact surface area may be increased by installing baffles or similar devices. The problem here is that relatively high specific water quantities must be used—on the order of 1–5 $l/m^3$ gas—in order to assure proper wetting of the gas/water contact surfaces and also to keep the proportion of scrubbed-out contaminants small since otherwise such contaminants may become deposited on various surfaces and cause problems. If baffles or similar elements are not used and the water is sprayed into the gas stream, it is a frequent occurrent for scrubbed-out contaminants to foul the spray nozzles and cause uneven spray distribution. Moreover, because of the high water requirements of these devices it is customary to recycle a portion of the used scrubbing water back into the device, together with fresh water, and the contaminants contained in this recycled water tend to clog the circulation pumps and to cause corrosion of the pump parts with which they come in contact.

Other types of scrubbing equipment are also known, for example turbulent-flow scrubbers. These largely avoid the use of baffles and similar devices so as to reduce the aforementioned problems. However, they require large quantities of water and the gas/water contact is not as effective as in the previously discussed type.

Venturi scrubbers are used primarily for non-pressurized gases and suffer from the problems outlined earlier, i.e. fouling by deposition of scrubbed-out dust and erosion of the pump components due to recirculation of parts of the contaminated scrubbing water.

Rotary scrubbers are also known, which have rotating baffles or similar instrumentalities. Because of the problems encountered with the rotating components and the electrical energy requirements for driving the same, such rotary scrubbers are used only rarely and are not known ever to have been used to scrub contaminants from gases which are under pressure.

Finally, it has been proposed to use two-stage devices—a prescrubber and a subsequently arranged venturi tube or disintegrator—to obtain cooling of the gas in conjunction with a high rate of dust removal and maximum gas saturation with water vapor. However, these devices also require a very large amount of water and the problems resulting from contamination of the device with particles scrubbed out of the gas continue to be present in them.

SUMMARY OF THE INVENTION

Accordingly, it is a general object of the invention to overcome the disadvantages of the prior art.

A more particular object of the invention is to provide an improved method of cooling, scrubbing and vapor-saturating dust-laden pressurized product gases which may be at pressures of about 5–70 bar and have temperatures between about 800°–1600° C.

A concomitant object of the invention is to provide an apparatus for carrying out the method.

In keeping with the above objects, and with still others which will become apparent hereafter, one feature of the invention resides in a method of processing dust-contaminated hot product gas. Briefly stated, this method may comprise the steps of admitting a stream of the hot product gas with a vessel suspended within a water bath and having a plurality of outlet openings through which the gas escapes to ascent through the bath; channelling the gas ascending from the respective outlet openings in respective upright confined paths, so that the ascending gas causes agitation and turnover of the bath and is cooled and scrubbed of its dust during the ascent; intercepting the ascending gas in the region of an upper surface of the bath to prevent roiling of the upper surface; discharging the cooled and scrubbed gas from the space above the upper bath surface; and continuously discharging dust-contaminated water via an overflow from the bath while replenishing the latter.

An apparatus for carrying art the method may comprise a receptacle for a water bath; a vessel suspended in the water bath and having a plurality of outlet openings; means for admitting a stream of the hot product gas into the vessel so that the product gas escapes through the outlet openings and ascends through the bath; means for channeling the ascending gas for flow in respective upright confined paths so that the gas causes agitation and turnover of the bath and is cooled and scrubbed of its dust during the ascent; means for intercepting the ascending gas in the region of an upper surface of the bath to prevent roiling of the upper surface; means for discharging the cooled and scrubbed gas from the region of the receptacle above the upper surface; and means for continuously discharging dust-contaminated water via an overflow from the bath while replenishing the latter.

The novel features which are considered as chracteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

The sole FIGURE is a diagramatic vertical section through an apparatus embodying the invention.

DESCRIPTION OF THE PREFERRED EMBODIMENTS

The inventive method and apparatus will hereafter be jointly discussed with reference to the FIGURE. It should be noted, however, that the gasifying reactor from which the hot product gas and liquid slag are derived, is illustrated only by way of a labelled box because it is known per se and does not form part of the present invention.

With this in mind it will be seen that the illustrated apparatus has a receptacle R constructed as a pressure vessel in which wall means W forms an inner container which is connected at its upper end (e.g. by welding) to the receptacle R and the lower end of which tapers conically in downward direction to form a convergent portion 3 leading to an outlet port 4 (controlled by a suitable not-illustrated valve). The container formed by wall W accomodates a water bath 2 the upper level of which is indicated by reference numeral 2*a*. A guide tube 1 is mounted in any manner known per se in the receptacle R, preferably concentrically therewith. Its upper end receives dust-laden product gas and liquid slag from the gasifier in form of continuous streams. The tube 1 extends through the water bath 2 and its lower end extends into a cupped shell 5. The lower end of the shell 5 is open and liquid of the bath 2 is therefore present in the shell; the upper wall of the shell is provided with an annulus (or a partial annulus) of e.g. ten equidistantly spaced outlets 6 which surround the tube 1.

Mounted in the bath 2 in any suitable manner are several short upright tubes 7, one for each outlet 6. Each tube 7 is vertically aligned with one of the outlets. Mounted above each tube 7, again in any suitable manner, is a downwardly open hollow conical hood 8; these are so located that at least their lower open ends are just below the water level 2*a*.

When the dust-laden hot product gas under pressure, and the liquid slag flowing with it, enter through the tube 1 into shell 5, the gas displaces the water of bath 2 from the shell 5 and escapes through the outlets 6 to ascend in the bath. In so doing it becomes cooled and dust is scrubbed out from it. The partial streams of gas rising from the respective outlets are guided in their upward movement by the respective tubes 7, which leads to a constant turn-over of the water of bath 2 since the tubes 7 operate on the principle of an airlift pump according to which the upflowing gas constantly draws water into the lower end of the respective tube 7 and expels the water from the upper end of the tube. As the gas nears the surface 2*a* it is intercepted by respective hoods 8 which prevent excessive roiling of the surface 2*a during escape of the gas from beneath the hoods.*

By the time the gas enters the space above the surface 2*a* it is largely freed of dust, is cooled and is saturated to the point of equilibrium with water vapor. It is discharged from the outlet 9 for further use. The contaminated water of bath 2, with the particles of dust scrubbed from the gas suspended in it, is continuously discharged via the overflow inlet 11*a* of discharge conduit 11; the water thus lost is equally continuously replenished via the water inlet 10.

The liquid slag which also drops through the tube 1, falls through the shell 5 and into the water bath 2 where it solidifies due to the instant cooling, and cracks apart into granules as a result of the stresses resulting from the sudden cooling. These granules settle in the convergent portion 3 from which they are discontinuously removed by opening the outlet port 4.

The ratio of the depth to which the tube 1 extends into the bath 2 to the overall height of the water bath is about 1:1 to 1:2. The ratio of the individual diameter of the outlets 6 to the diameter of the respectively associated tubes 7 which guide the rising gas bubbles is 1:1.5 to 1:2.5, with 1:2 being currently preferred.

Operating tests were carried out with an apparatus corresponding to the one described with reference to the FIGURE, using a product gas obtained by gasification of powdered lignite coal. The following results were obtained:

| | |
|---|---|
| **Input of Dust-Laden Product Gas** | |
| Volume | 40000 $m^3{}_N$/h (dry) |
| Temperature | 1400° C. |
| Pressure | 25 bar |
| Dust content | 125 $g/m^3{}_N$ |
| **Output of Processed Gas** | |
| Volume | 40000 $m^3{}_N$/h (dry) |
| Temperature | 200° C. |
| Pressure | 24.9 bar |
| Dust content | 10 $g/m^3{}_N$ |
| Water vapor content | saturated at 200° C. |
| **Water** | |
| Water input | 80 $m^3$/h |
| Temperature of incoming water | 150° C. |

These tests clearly indicate the superior results obtained with the invention.

While the invention has been illustrated and described as embodied in the processing of product gas, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of processing hot gas containing dust and/or liquid slag and produced by gasification of finely divided fuel under pressure and at high temperature, by introducing said hot gas into a water bath and causing it to ascend through said water bath, comprising the steps of admitting a stream of said hot gas into a vessel located within the water bath and having an open lower end and a plurality of upper outlet openings through which the gas escapes to ascend through the bath; confining the gas ascending from the respective outlet openings to flow in respective upright paths, so that the ascending gas causes agitation and turnover of the bath and is cooled and scrubbed of its dust and slag during the ascent, and the slag is solidified and granulated by the contact with the water bath; intercepting the ascending gas substantially at the level of an upper surface of the bath to prevent roiling of the upper surface; discharging the cooled and scrubbed gas from the space above the upper bath surface; discharging at least a part of the dust and the solidified granulated slag, which settle in a lower portion of the water bath, via an outlet from the lower portion of the bath; and continuously discharging dust-contaminated water via an overflow from the bath while replenishing the latter.

2. A method as defined in claim 1, wherein the product gas is admitted into the vessel under a pressure of about 5–70 bar.

3. A method as defined in claim 1, wherein the product gas is admitted into the vessel at a temperature between about 800–1600° C.

4. Apparatus for processing hot gas containing dust and/or liquid slag and produced by gasification of finely divided fuel under pressure and at high temperature, comprising a receptacle for a water bath; a vessel suspended in the water bath and having a plurality of outlet openings; means for admitting a stream of the contaminated hot gas into the vessel so that the gas escapes through the outlet openings and ascends through the bath; means for confining the ascending gas for flow in respective upright paths so that the gas causes agitation and turnover of the bath and is cooled and scrubbed of its dust and slag during the ascent, and the slag is solidified and granulated by contact with the water bath; means for intercepting the ascending gas substantially at the level of an upper surface of the bath to prevent roiling of the upper surface; the intercepting means comprising a plurality of downwardly open hoods located at least in part above said upper surface of the bath; means for discharging the cooled and scrubbed gas from the region of the receptacle above the upper surface of the bath; means for discharging water comprising an outlet and an overflow tube communicating with said outlet and having an intake located at the level of said hoods; means for continuously discharging dust-contaminated water via the overflow tube from the bath while replenishing the latter; and means for discharging at least a part of the dust and granulated slag, which settle in a lower portion of the water bath, via an outlet from the lower portion of the bath.

5. Apparatus as defined in claim 4, wherein said vessel has a lower open end and an upper wall provided with a plurality of said outlet openings.

6. Apparatus as defined in claim 5, wherein said admitting means comprises an upright guide conduit having an upper open end above the bath and vessel, and a lower open end extending into the vessel.

7. Apparatus as defined in claim 6, wherein said confining means comprises a plurality of open-ended upright tubes suspended in the bath and each located above and aligned with one of said outlet openings.

8. Apparatus as defined in claim 7, wherein said hoods are each mounted above an upper open end of a respective one of said tubes.

9. Apparatus as defined in claim 8, wherein said hoods are hollow cones having lower open ends.

* * * * *